United States Patent [19]

Kaczynski et al.

[11] Patent Number: 4,821,696

[45] Date of Patent: Apr. 18, 1989

[54] DEVICE FOR INJECTING FUEL INTO A COMBUSTION CHAMBER OF AN INTERNAL COMBUSTION ENGINE

[75] Inventors: Bernhard Kaczynski, Waiblingen; Alfred Schmitt, Ditzingen; Ewald Eblen, Stuttgart; Iwan Komaroff, Regensburg, all of Fed. Rep. of Germany

[73] Assignee: Robert Bosch GmbH, Stuttgart, Fed. Rep. of Germany

[21] Appl. No.: 159,521

[22] PCT Filed: Jan. 14, 1987

[86] PCT No.: PCT/DE87/00012

§ 371 Date: Jan. 7, 1988

§ 102(e) Date: Jan. 7, 1988

[87] PCT Pub. No.: WO87/06978

PCT Pub. Date: Nov. 19, 1987

[30] Foreign Application Priority Data

May 9, 1986 [DE] Fed. Rep. of Germany ..... 3615636

[51] Int. Cl.[4] ..... F02M 53/06; F02M 57/00

[52] U.S. Cl. ..... 123/298; 123/549; 123/145 A

[58] Field of Search ..... 123/297, 298, 543, 549, 123/145 A

[56] References Cited

U.S. PATENT DOCUMENTS

| | | | |
|---|---|---|---|
| 1,693,966 | 12/1928 | Sperry | 123/145 A |
| 1,927,562 | 9/1933 | Dorner et al. | 123/145 A |
| 1,935,171 | 11/1933 | Woolson | 123/145 A |
| 3,648,669 | 3/1972 | Rank | 123/32 AH |
| 4,572,146 | 2/1986 | Grünwald et al. | 123/145 A |
| 4,603,667 | 8/1986 | Grünwald et al. | 123/297 |
| 4,627,405 | 12/1986 | Imhof et al. | 123/298 X |

FOREIGN PATENT DOCUMENTS

| | | | |
|---|---|---|---|
| 0158739 | 10/1985 | European Pat. Off. . | |
| 0188745 | 7/1986 | European Pat. Off. . | |
| 1256942 | 12/1967 | Fed. Rep. of Germany . | |
| 3224048 | 12/1983 | Fed. Rep. of Germany | 123/297 |
| 3335920 | 4/1985 | Fed. Rep. of Germany | 123/298 |
| 3404708 | 8/1985 | Fed. Rep. of Germany | 123/298 |
| 2220017 | 9/1974 | France . | |
| 2153909 | 8/1985 | United Kingdom . | |

*Primary Examiner*—Willis R. Wolfe

*Attorney, Agent, or Firm*—Michael J. Striker

[57] ABSTRACT

A device for injecting fuel into a combustion chamber of an internal combustion engine, having a glow coil (22, 92) disposed on the outlet side of the injection nozzle and increasing in size conically toward the combustion chamber; the coil is surrounded by a sleeve (30, 96) which firmly holds the end turn (88, 93) of the glow coil (22, 92) toward the combustion chamber and has a contact ring washer (46, 98), on which the other end turn (86, 94) of the glow coil (22, 92) is secured. The end turn (88, 93) toward the combustion chamber rests on an annular shoulder (90, 107), oriented according to the invention toward the combustion chamber, of the sleeve (30, 96), which surrounds an insertion opening (91, 106) the inside diameter of which is smaller than the outside diameter of the end turn (88, 93) toward the combustion chamber, but greater than the outside diameters of all the other turns of the glow element (22, 92). As a result, the glow coil (22, 92) can still be inserted and electrically contacted once the contact ring washer (46, 98) has already been fastened to the sleeve (30, 96) and with it forms a pre-fabricated structural unit.

11 Claims, 2 Drawing Sheets

DEVICE FOR INJECTING FUEL INTO A COMBUSTION CHAMBER OF AN INTERNAL COMBUSTION ENGINE

PRIOR ART

The invention is based on a device for injecting fuel. In a device of this generic type which belongs to the prior art described e.g. in the German patent application No. P 35 02 110.1, the annular shoulder on the sleeve, which firmly retains and electrically contacts the end of the glow element toward the combustion chamber, is oriented toward the injection nozzle, that is, counter to the fuel flow, so that the glow element must be inserted into the sleeve from the end of the sleeve oriented toward the injection nozzle. As a result, the contact ring washer that firmly retains and electrically contacts the end of the glow element remote from the combustion chamber cannot be fastened until after the insertion of the glow element, which under some conditions makes assembly of the parts more difficult.

ADVANTAGES OF THE INVENTION

The arrangement according to the invention has the advantage over the prior art that the glow element can be inserted into the sleeve from the face end of the sleeve oriented toward the combustion chamber, so that the contact ring washer can be fastened to the sleeve even before the insertion of the glow element and can be pre-fabricated with the sleeve into a structural unit.

Advantageous further embodiments of the arrangement according to the main claim are possible by means of the provisions recited in the dependent claims.

The insertion of the glow element into the sleeve is facilitated if the glow element, in the known manner, has an outside diameter that decreases continuously toward the injection nozzle.

By means of the constructional characteristics according to the invention, the fastening and electrical contacting of the glow element on the contact ring washer are facilitated. The greater the helical pitch of the turn adjacent to the end turn of the glow element, the larger is the angle over which the end turn can be grasped by the inner ring rim of the contact ring washer. The tongues of the contact ring washer formed on the inner ring rim, after having been deformed, firmly hold the end turn of the glow element in the prescribed position, once the glow element is joined to the contact ring washer in an ensuing operation, for instance by laser welding.

In the same advantageous manner, the end of the glow element toward the combustion chamber can be connected to the sleeve and electrically contacted if the sleeve is embodied in accordance with claim 7. The sheet-metal element, together with ceramic elements disposed on both side of the contact ring washer and serving to fasten the washer in an insulated manner, can form the sleeve, which makes manufacture easier and less expensive and also makes better use of the restricted space available than when a sleeve produced by metal-cutting techniques is used.

It is particularly advantageous if the glow element is wound from a flat strip that is cut out in the form of a spiral from a flat sheet-metal element (plate, strip) and subsequently pulled axially apart to form a conicl helix. The two contact rings on the ends are then obtained without additional labor cost. This embodiment of the glow element has the advantage that the coil can be made of a special material that is obtainable only in plate or strip form, and that flat bearing faces extending over a closed circular circumference are available on the coil, which make a secure fastening and electrical contacting substantially easier.

By the elimination of a metal support washer between the thermal insulation ring and the adjoining insulating body, the structural height of the structural assembly, comprising the sleeve, contact ring washer and the two insulating bodies, can be reduced still further.

DRAWING

Two exemplary embodiments of the invention are shown in the drawing and explained in further detail in the ensuing description. FIG. 1 shows an enlarged longitudinal section through the end toward the combustion chamber of an injection nozzle having an integrated glow insert, as a first exemplary embodiment; FIG. 2 is a plan view on the glow element of the glow insert of FIG. 1 in an intermediate stage of manufacture; FIG. 3 is a longitudinal section through the second embodiment; and FIG. 4 is a fragmentary view of the contact ring washer of FIG. 3, in the direction of the arrow A shown there.

DESCRIPTION OF THE EXEMPLARY EMBODIMENTS

Figure 1:
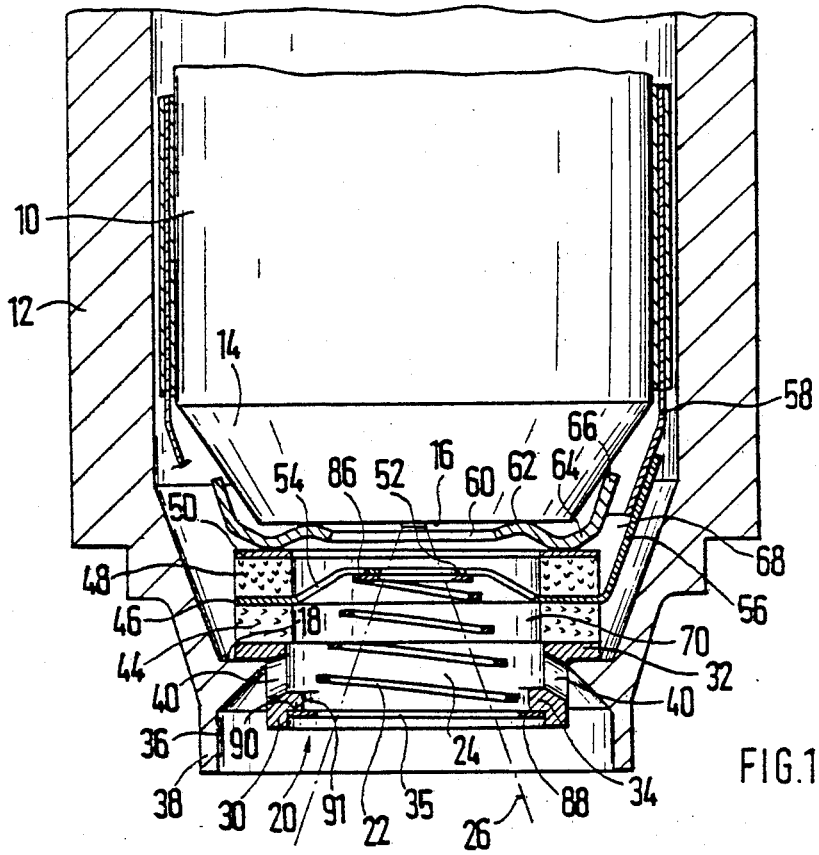
Figure 2:
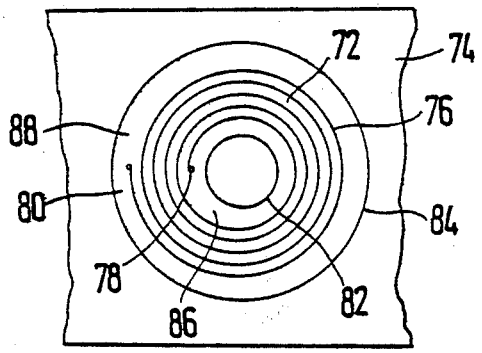

The injection nozzle of FIGS. 1 and 2 has a nozzle body 10, in which in a known manner a valve seat is formed and a valve needle is displaceably supported. The nozzle body 10 and an intermediate washer that limits the stroke of the valve needle are fastened by means of a union nut 12 to a nozzle holder, in which among other elements, a closing spring that presses the valve needle against the valve seat is accommodated. On the face end toward the combustion chamber, the nozzle body 10 is provided with a frustoconical wall section 14, which merges with a flat end wall 16.

The union nut 12 is extended beyond the nozzle body 10 toward the combustion chamber, and downstream from the end wall 16 is provided with an inner support shoulder 18, on which a glow insert identified overall by reference numeral 20 rests. This glow insert has as a central structural component a glow element 22 embodied as a helix, which forms a passageway 24 for the injection streams 26. The glow element 22 is dimensioned such that the injection streams do not moisten the glow element, but instead produce an injector action, by means of which air is aspirated out of the combustion chamber into the interior of the glow element 22 and into the peripheral zones of the injection streams passing through the glow element.

The glow element 22 is surrounded by a metal sleeve 30, which has a flange 32 that rests on the support shoulder 18 of the union nut 12. On the side toward the combustion chamber, the sleeve 30 is provided with an inwardly oriented annular collar 34, on which the glow element 22 is supported in a centered manner and for instance soldered in place. Downstream of the support shoulder 18, the union nut 12 has an enlarged bore section 36 in an annular collar 38, which protectively surrounds the face end, toward the combustion chamber, of the sleeve 30 and of the glow element 22. Between the flange 32 and the annular collar 34, the sleeve 30 is provided with a plurality of uniformly distributed bores 40 in the jacket wall, which discharge into the enlarged bore section 36 of the union nut 12.

A first annular insulating body 44, a metal contact ring washer 46, a second annular insulating body 48 and a metal support washer 50 rest on the flange 32 of sleeve 30, one above the other. These elements are firmly connected with one another and with the sleeve 30, for instance by soldering, when ceramic bodies that have been metallized on the flat face ends are used as insulating bodies 44, 48. The upstream end of the glow element 22 is soldered on an inner annular zone 52 of the contact ring washer 46, which is provided with a plurality of uniformly distributed openings 54 in the middle area of the ring. On the outer rim of the ring, the contact ring washer 46 is provided with three upwardly protruding contact lugs 56, which are offset by 120° from one another and are conductively joined to a current carrying sleeve 58 that extends through them, insulated by the annular gap between the nozzle body 10 and the union nut 12, as far as a connection site, located at a higher level, of an external supply line.

Between the support washer 50 and the nozzle body 10, a metal thermal insulation ring 60 is fastened in a deformed manner, pressing with an inner ring rim 62 against the end wall 16 of the nozzle body 10. A middle annular region 64 of the thermal insulation ring 60 that is axially offset with respect to the inner ring rim 62 rests on the support ring 50, and an outer ring rim 66 rests on the conical wall portion 14 of the nozzle body 10. As a result, the thermal insulation ring 60 is centered on the nozzle body 10, and the passageway 24 is satisfactorily sealed off from the chamber 68 surrounding the thermal insulation ring 60.

Between the sleeve 30 and the glow element 22, an annular chamber 70 is formed, which communicates via the bores 40 in the sleeve 30 and via the enlarged bore section 36 of the union nut with the combustion chamber. Via the flow path described and the interstices between turns of the glow element 22, the injection streams 26 aspirate air from the combustion chamber by injector action, and this air, heated at the glow element (22), reaches the peripheral zones of the injection streams and there forms a readily ignitable fuel-air mixture. Because of the embodiment of the glow element 22, which is well adapted to the shape of the stream, the injector action of the injection streams 26 is improved. The enlargement of the cross section of the annular chamber 70 toward the injection nozzle makes for a uniform entry of air into the injection streams over the entire length of the glow element 22, and thermally relieves the insulating bodies 44, 48 and the points where they are connected to the metal parts resting on them. The conical embodiment also improves the dynamic behavior of the glow coil and reduces the danger of breakage.

The pre-fabricated component embodied by the elements 22, 30 and 44–50, is inserted into the union nut 12 from the upstream side thereof and pushed in until it rests on the support shoulder 18. After that, the sleeve can be glued, soldered or welded to the union nut 12 at a suitable point. The subsequent assembly of the injection nozzle is suitably effected such that the nozzle holder, the intermediate washer and the nozzle body 10 are placed on one another in reverse order; the thermal insulation ring 60 is slipped onto the nozzle body 10, and then the union nut 12 and the glow insert 20 together are put in inverted position onto the parts and screwed onto the nozzle holder, during which the self-clamping thermal insulation ring 60 is kept centered on the nozzle body 10.

The glow element 22 is wound from a flat strip 72 (FIG. 2) so that the individual turns have a rectangular cross section. The flat strip 72 is cut out of a flat sheet-metal element in the form of a spiral and after that is pulled apart in the axial direction of the glow element 22 to form the conical helix. The spiral can for instance be cut out of the flat sheet-metal element by etching or, as shown in FIG. 2, by laser cutting. In FIG. 2 the flat starting portion is a sheet-metal strip 74, from which the spiral flat strip 72 is cut out by means of a cutting line 76 that begins at 78 and terminates at 80. In addition to the cutting line 76, an inner circular cutting line 82 and an outer circular cutting line 84 are provided, with which the spiral is cut out of the metal strip 74.

Because of the two cutting lines 82 and 84, the glow element 22 gains an inner closed contact ring 86 and an outer closed contact ring 88 at its ends, with which the glow element 22 is electrically contacted at the contact ring washer 46 and sleeve 30. By means of the described embodiment of the glow element 22, flat bearing surfaces are produced between the parts that are to be electrically contacted, and these bearing surfaces furthermore extend over one entire circular circumference and therefore enable excellent electrical contact and fastening.

The inwardly oriented annular collar 34 of the sleeve 30 has an annular shoulder 90 which according to the invention is oriented away from the nozzle body 10 and surrounds an insertion opening 91, the inside diameter of which is smaller than the outside diameter of the contact ring 88 of the glow element 22. The outside diameters of all the other turns of the glow element 22 are smaller than the inside diameter of the insertion opening 91, so that the glow element 22 can be inserted from the end toward the combustion chamber into the sleeve 30, until its contact rings 86, 88 come to rest on the already attached contact ring washer 46 and the sleeve 30 and electrically contacted by suitable methods, such as laser welding.

Figure 3:
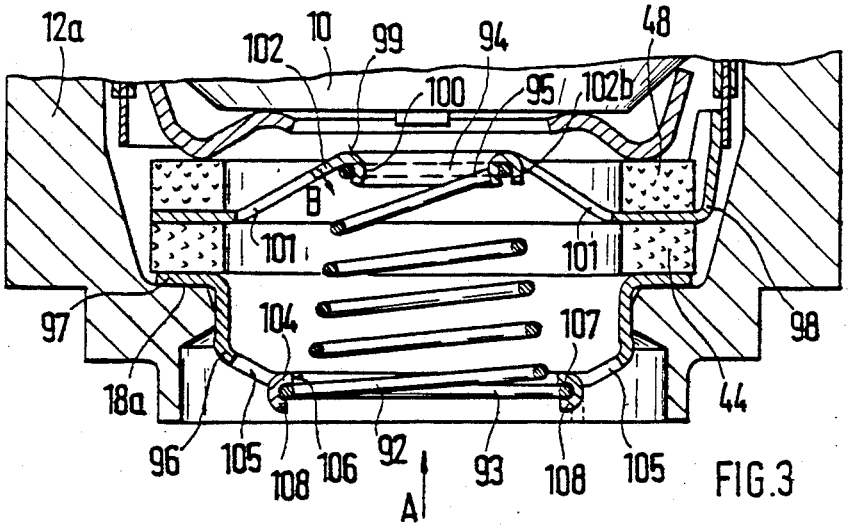
Figure 4:
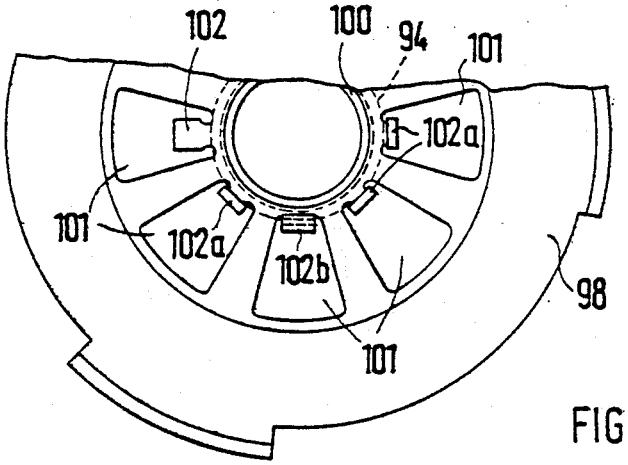

The device according to FIGS. 3 and 4, which basically has the same structure as that of FIG. 1 and 2, has a glow element 92 wound from round wire, the two end turns 93, 94 of which are located over the greatest possible circumference in a plane that is disposed at right angles to the axis of the glow element 22. In terms of the end turn 92 having the small diameter, this is reinforced by the provision that the adjacent turn 95 has a greater helical pitch than the other turns. The sleeve surrounding the glow element 22 here is formed by a cup-shaped sheet-metal element 96, which rests with a flange 97 on the shoulder 18*a* of the union nut 12*a*. Joined in turn with the flange are two ceramic insulating bodies 44, 48 and one contact ring washer 98, which firmly retains the upper end turn 94 of the glow element 92 in a centered manner and electrically contacts it.

To this end, the inner ring rim 99 of the contact ring washer 98 is provided with an axial collar 100, which has a cylindrical shape prior to the insertion of the glow element 92 and is adapted to the inner diameter of the end turn 94. In the middle ring region, the contact ring washer 98 is provided with eight recesses 101 distributed uniformly over the circumference, by means of which recesses, during operation, the aspirated air can also enter the annular space located between the glow element 92 and the nozzle body 10. A tongue 102 originating at the inner ring rim 99 protrudes into each recess 101 and after the insertion of the glow element 92 is wrapped around the end turn 94 thereof, as the arrow B in FIG. 3 indicates. The tongue 102 is brought beyond the intermediate stage 102*a* into its final shape 102*b*, whereupon or after which the rim of the collar 100 is pressed slightly outward; as a result, the end turn 94 is firmly retained in a captive and play-free manner.

The end turn 93 toward the combustion chamber of the glow element 22 has an inside diameter that is greater than the outside diameter of the adjoining turn and of all the other turns. The sheet-metal element 96 has a bottom 104 having ventilation openings 105 and a central insertion opening 106, the inside diameter of which is smaller than the outside diameter of the end turn 93 but greater than the diameter of all the other turns of the glow element 22. The end turn 93 of the glow element 22 rests on an annular shoulder 107 that surrounds the insertion opening 106 and in accordance with the invention is oriented away from the nozzle element 10 and is likewise firmly retained by tongues 108 integrally molded onto the ring rim 104, these tongues, after the insertion of the glow element 92, being wrapped around its end turn 93. In this exemplary embodiment as well, the insertion of the glow element 92 can be accomplished after the contact ring washer 98 has already been fastened to the sheet-metal element 96 via the insulating body 44. Upon being joined to the contact ring washer 98 and the sheet-metal element 96, for example by laser welding, the glow element is firmly retained in a centered fashion, in an appropriate manner for manufacture, by the tongues 102 and 108.

We claim:

1. A device for injecting fuel into a combustion chamber of an internal combustion engine, having an injection nozzle and a glow element arranged opposite the outlet side of the nozzle and embodied as a helix, which forms a passageway for the fuel injection streams and is surrounded with radial play be a sleeve, comprising a radially inwardly directed collar formed at the end of said sleeve remote from the nozzle and surrounding an insertion opening for said glow element, the inside diameter of said insertion opening being smaller than the outside diameter of one end turn of said glow element facing the combustion chamber, and the outside diameters of all the remaining turns of the glow element being equal or less than the inside diameter of the insertion opening; said collar having an annular shoulder facing the combustion chamber, said one end turn of the glow element being secured on and making an electrical contact with said annular shoulder; a contact ring washer secured in an insulated manner on the other end of said sleeve facing the nozzle, said contact ring washer having an inner ring rim which firmly retains and electrically contact the other end turn of said glow element.

2. A device as defined by claim 1, wherein the glow element has an outside diameter that decreases continuously toward the injection nozzle.

3. A device as defined by claim 1, wherein the major part of the other end turn oriented toward the nozzle body of the glow element, over the largest is located in a plane disposed at right angles to the axis of the glow element, and that the inner ring rim of the contact ring washer, which is of sheet metal, grasps said other end turn of the glow element with a plurality of claws distributed over the circumference and formed by local deformations of the inner ring rim.

4. A device as defined by claim 3, the turn of the glow element adjacent to said other end turn has a greater helical pitch than the other turns.

5. A device as defined by claim 3, wherein the contact ring washer is provided in the middle ring region with a plurality of recesses distributed over the circumference, and that the claws grasping the other end turn of the glow element are formed by bentover tongues on the inner ring rim of the contact ring.

6. A device as defined by claim 3, wherein the inner ring rim of the contact ring washer is provided with an axial collar that centers on its inside the other end turn of the glow element.

7. A device as defined by claim 1 the sleeve surrounding the glow element is embodied in at least in part by a cup-shaped sheet-metal element having an inner ring rim provided with a bottom opening; and the one end turn of the glow element is firmly retained on said inner ring rim by bent-over tongues.

8. A device as defined by claim 13, wherein the glow element is wound from a flat srip, which is cut out in the form of a spiral from a flat sheet-metal element and after that is pulled axially apart to form a conical helix.

9. A device as defined by claim 8, characterized in that one closed contact ring (86, 88) is integrally formed onto each of the ends of the flat strip (72) forming the glow element (22).

10. A device as defined by claim 13, having a thermal insulation ring, which is supported at one face thereof on the nozzle and at the outer face thereof via insulating bodies on the sleeve surrounding the glow element, and the one face of the thermal insulation ring resting directly on the adjoining insulating body.

11. A device as defined in claim 10 wherein a metal support washer is disposed between said one face of the thermal insulation ring and the adjoining insulating body.

* * * * *